US007896625B2

(12) United States Patent
Schofield

(10) Patent No.: US 7,896,625 B2
(45) Date of Patent: Mar. 1, 2011

(54) VACUUM PUMPING SYSTEM AND METHOD OF OPERATING A VACUUM PUMPING ARRANGEMENT

(75) Inventor: Nigel Paul Schofield, Horsham (GB)

(73) Assignee: Edwards Limited, Crawley, West Sussex (GB)

( * ) Notice: Subject to any disclaimer, the term of this patent is extended or adjusted under 35 U.S.C. 154(b) by 763 days.

(21) Appl. No.: 10/536,775

(22) PCT Filed: Dec. 9, 2003

(86) PCT No.: PCT/GB03/05380

§ 371 (c)(1),
(2), (4) Date: Jan. 23, 2006

(87) PCT Pub. No.: WO2004/055377

PCT Pub. Date: Jul. 1, 2004

(65) Prior Publication Data

US 2006/0153715 A1 Jul. 13, 2006

(30) Foreign Application Priority Data

Dec. 17, 2002 (GB) ..... 0229353.8

(51) Int. Cl.
*F04B 35/04* (2006.01)

(52) U.S. Cl. ..... 417/423.4; 137/565.23

(58) Field of Classification Search ..... 417/423.4, 417/53; 118/50, 715; 137/565.23
See application file for complete search history.

(56) References Cited

U.S. PATENT DOCUMENTS 3,536,418 A * 10/1970 Breaux ..... 417/49
3,649,339 A * 3/1972 Smith ..... 417/152
4,472,962 A * 9/1984 Mennenga ..... 73/40.7
4,534,314 A * 8/1985 Ackley ..... 118/733
4,577,465 A * 3/1986 Olsen et al. ..... 62/55.5
4,919,599 A * 4/1990 Reich et al. ..... 417/423.4
6,135,709 A * 10/2000 Stones ..... 415/90
6,161,576 A * 12/2000 Maher et al. ..... 137/565.23
6,375,413 B1 * 4/2002 Stones ..... 415/90
6,446,651 B1 * 9/2002 Abbel ..... 137/1
6,598,615 B1 * 7/2003 Holland et al. ..... 137/14
6,644,931 B2 * 11/2003 Puech ..... 417/205
6,669,987 B1 * 12/2003 Schaefer et al. ..... 427/248.1
7,101,155 B2 * 9/2006 Savidge et al. ..... 417/53

(Continued)

FOREIGN PATENT DOCUMENTS

DE 199 13 593 A 1 10/2000

(Continued)

OTHER PUBLICATIONS

United Kingdom Search Report for Application No. GB 0229353.8; Date of search: Jul. 16, 2003.

(Continued)

*Primary Examiner*—Devon C Kramer
*Assistant Examiner*—Christopher Bobish

(57) ABSTRACT

A vacuum pumping system comprises a vacuum pumping arrangement comprising: a drive shaft; a motor for driving said drive shaft; a molecular pumping mechanism comprising a turbomolecular pumping mechanism; and a backing pumping mechanism. The drive shaft drives said molecular pumping mechanism and said backing pumping mechanism. The system also comprises an evacuation mechanism, such as a load lock pump, for evacuating at least, said turbomolecular pumping mechanism.

17 Claims, 6 Drawing Sheets

U.S. PATENT DOCUMENTS

| | | | | |
|---|---|---|---|---|
| 7,600,989 | B2 * | 10/2009 | Bohm | 417/423.4 |
| 2002/1036643 | | 9/2002 | Eberl | |

FOREIGN PATENT DOCUMENTS

| | | |
|---|---|---|
| DE | 100 32 607 A 1 | 1/2002 |
| DE | 100 43 783 A 1 | 3/2002 |
| DE | 101 14 969 A 1 | 10/2002 |
| EP | 0 898 083 A2 | 2/1999 |
| EP | 1 234 982 A | 8/2002 |
| JP | 5033044 | 2/1993 |

OTHER PUBLICATIONS

International Search Report for International Application No. PCT/GB 03/05380; Date of mailing of the International search report: Mar. 18, 2004.

* cited by examiner

VACUUM PUMPING SYSTEM AND METHOD OF OPERATING A VACUUM PUMPING ARRANGEMENT

FIELD OF THE INVENTION

The present invention relates to a vacuum pumping system comprising a vacuum pumping arrangement and a method of operating a vacuum pumping arrangement.

BACKGROUND OF THE INVENTION

A known vacuum pumping arrangement for evacuating a chamber comprises a molecular pump which may include: molecular drag pumping means; or turbomolecular pumping means; or both molecular drag pumping means and turbomolecular pumping means. If both pumping means are included the turbomolecular pumping means are connected in series with the molecular drag pumping means. The pumping arrangement is capable of evacuating the chamber to very low pressures in the region of $1\times10^{-6}$ mbar. The compression ratio achieved by the molecular pump is not sufficient to achieve such low pressures whilst at the same time exhausting to atmosphere and therefore a backing pump is provided to reduce pressure at the exhaust of the molecular pump and hence permit very low pressures to be achieved at the inlet thereof.

The turbomolecular pumping means of a molecular pump comprises a circumferential array of angled blades supported at a generally cylindrical rotor body. During normal operation the rotor is rotated between 20,000 and 200,000 revolutions per minute during which time the rotor blades collide with molecules in a gas urging them towards the pump outlet. Normal operation occurs therefore at molecular flow conditions at pressures of less than about 0.01 mbar. As it will be appreciated, the turbomolecular pumping means does not work effectively at high pressures, at which the angled rotor blades cause undesirable windage, or resistance to rotation of the rotor. This problem is particularly acute at start up conditions close to or at atmospheric pressure, when it is difficult if not impossible to rotate the rotor of the turbomolecular pumping means at high speed. Therefore, it is desirable to evacuate the turbomolecular pumping means to relatively low pressures by operating the backing pump before starting rotation of the molecular pump. An alternative but undesirable solution to the problem of turbo stage start-up, would be the provision of a much more powerful motor for driving the rotor, that would be able to overcome the windage caused by the angled rotors blades at atmospheric pressure. This solution is undesirable because, generally, a molecular pump, especially when used in the semiconductor processing industry, is kept running most of the time, and is shut down only during power failures, for servicing etc. Accordingly, a powerful motor would be needed only for a relatively small amount of the pump's operating time and therefore the increased cost of such a motor cannot be justified.

Hereto, a molecular pump and a backing pump thereof are separate units of the same vacuum pumping arrangement, the pumps being associated with respective drive shafts which are driven by respective motors. As described above, it is desirable initially to operate the backing pump to evacuate the molecular pump, prior to start-up of the molecular pump. Clearly, this would be possible only if the two pumps can be driven separately.

It is desirable to provide an improved vacuum pumping system and method of operating a vacuum pumping arrangement.

BRIEF SUMMARY OF THE INVENTION

The present invention provides a vacuum pumping system comprising a vacuum pumping arrangement comprising: a drive shaft; a motor for driving said drive shaft; a molecular pumping mechanism comprising turbomolecular pumping means; and a backing pumping mechanism, wherein said drive shaft is for driving said molecular pumping mechanism and said backing pumping mechanism, and the system comprises evacuation means for evacuating at least said turbomolecular pumping means.

The present invention also provides a method of operating a vacuum pumping arrangement comprising: a drive shaft; a motor for driving said drive shaft; a molecular pumping mechanism comprising turbomolecular pumping means; and a backing pumping mechanism, said drive shaft being for driving said molecular pumping mechanism and said backing pumping mechanism, the method comprising the steps of operating an evacuation means connected to the arrangement to evacuate the arrangement to a predetermined pressure and operating the motor to start rotation of the drive shaft.

Other aspects of the present invention are defined in the accompanying claims.

In order that the present invention may be well understood, some embodiments thereof, which are given by way of example only, will now be described with reference to the accompanying drawings, in which:

DETAILED DESCRIPTION OF THE INVENTION

Figure 1:
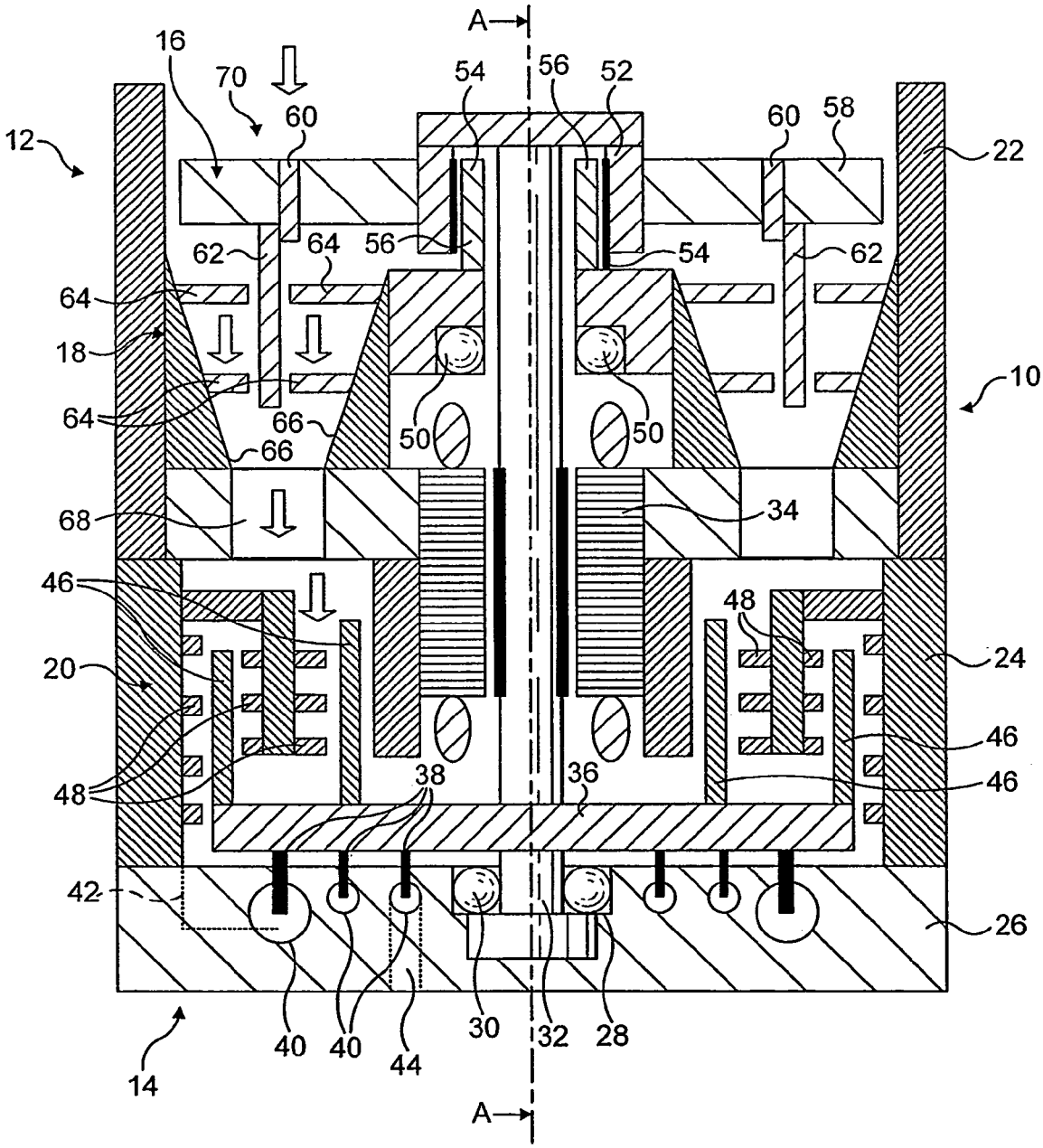
FIG. 1 is a cross-sectional view of a vacuum pumping arrangement shown schematically.

Referring to FIG. 1, a vacuum pumping arrangement 10 is shown schematically, which comprises a molecular pumping mechanism 12 and a backing pumping mechanism 14. The molecular pumping mechanism comprises turbomolecular pumping means 16 and molecular drag, or friction, pumping means 18. Alternatively, the molecular pumping mechanism may comprise turbomolecular pumping means only or molecular drag pumping means only. The backing pump 14 comprises a regenerative pumping mechanism. A further drag pumping mechanism 20 may be associated with the regenerative pumping mechanism and provided between drag pumping mechanism 18 and regenerative pumping mechanism 14. Drag pumping mechanism 20 comprises three drag pumping stages in series, whereas drag pumping mechanism 18 comprises two drag pumping stages in parallel.

Vacuum pumping arrangement 10 comprises a housing, which is formed in three separate parts 22, 24, 26, and which houses the molecular pumping mechanism 12, drag pumping mechanism 20 and regenerative pumping mechanism 14. Parts 22 and 24 may form the inner surfaces of the molecular pumping mechanism 12 and the drag pumping mechanism 20, as shown. Part 26 may form the stator of the regenerative pumping mechanism 14.

Part 26 defines a counter-sunk recess 28 which receives a lubricated bearing 30 for supporting a drive shaft 32, the bearing 30 being at a first end portion of the drive shaft associated with regenerative pumping mechanism 14. Bearing 30 may be a rolling bearing such as a ball bearing and may be lubricated, for instance with grease, because it is in as part of the pumping arrangement 10 distal from the inlet of the pumping arrangement. The inlet of the pumping arrangement may be in fluid connection with a semiconductor processing chamber in which a clean environment is required.

Figure 3:
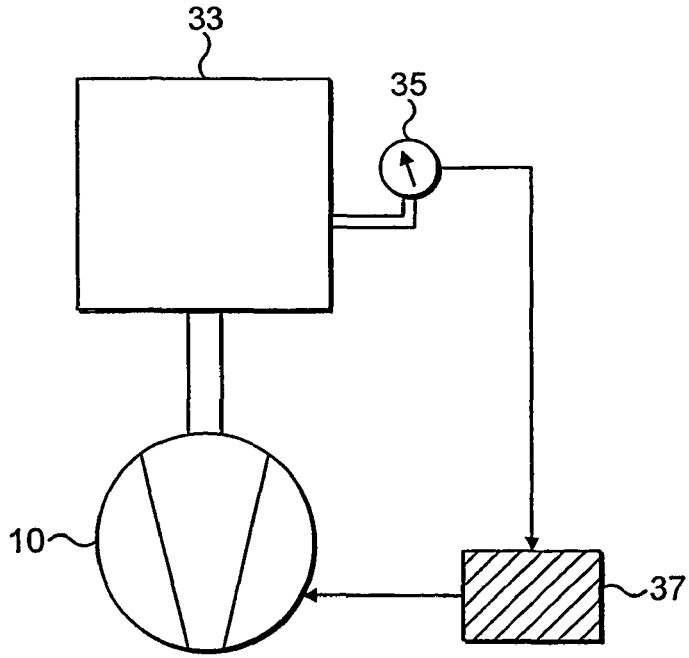
FIG. 3 is a diagram of a control system.

Drive shaft 32 is driven by motor 34 which as shown is supported by parts 22 and 24 of the housing. The motor may be supported at any convenient position in the vacuum pumping arrangement. Motor 34 is adapted to be able to drive simultaneously the regenerative pumping mechanism 14, and the drag pumping mechanism 20 supported thereby, and also the molecular pumping mechanism 12. Generally, a regenerative pumping mechanism requires more power for operation than a molecular pumping mechanism, the regenerative pumping mechanism operating at pressures close to atmosphere where windage and air resistance is relatively high. A molecular pumping mechanism requires relatively less power for operation, and therefore, a motor selected for powering a regenerative pumping mechanism is also generally suitable for powering a molecular pumping mechanism. Means are provided for controlling the rotational speeds of the backing pumping mechanism and the molecular pumping mechanism so that pressure in a chamber connected to, or operatively associated with, the arrangement can be controlled. A suitable control system diagram for controlling speed of the motor 34 is shown in FIG. 3 and includes a pressure gauge 35 for measuring pressure in a chamber 33 and a controller 37 connected to the pressure gauge for controlling the pump's rotational speed.

Regenerative pumping mechanism 14 comprises a stator comprising a plurality of circumferential pumping channels disposed concentrically about a longitudinal axis A of the drive shaft 32 and a rotor comprising a plurality of arrays of rotor blades extending axially into respective said circumferential pumping channels. More specifically, regenerative pumping mechanism 14 comprises a rotor fixed relative to drive shaft 32. The regenerative pumping mechanism 14 comprises three pumping stages, and for each stage, a circumferential array of rotor blades 38 extends substantially orthogonally from one surface of the rotor body 36. The rotor blades 38 of the three arrays extend axially into respective circumferential pumping channels 40 disposed concentrically in part 26 which constitutes the stator of the regenerative pumping mechanism 14. During operation, drive shaft 32 rotates rotor body 36 which causes the rotor blades 38 to travel along the pumping channels, pumping gas from inlet 42 in sequence along the radially outer pumping channel, radially middle pumping channel and radially inner pumping channel where it is exhausted from pumping mechanism 14 via exhaust 44 at pressures close to or at atmospheric pressure.

Figure 2:
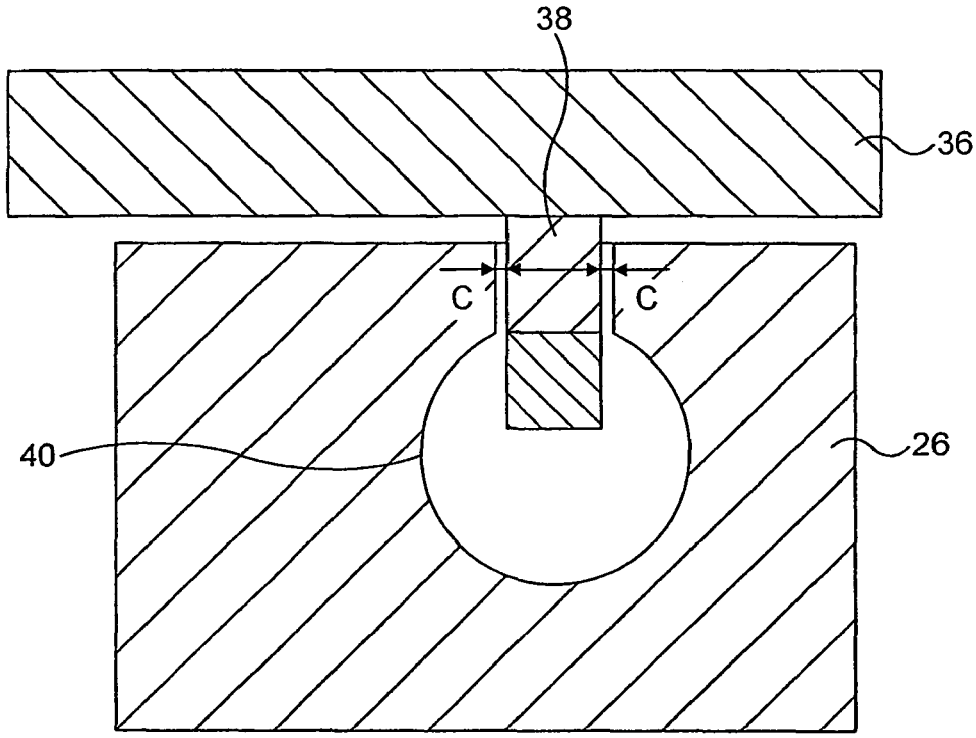
FIG. 2 is an enlarged cross-sectional view of a portion of a regenerative pump of the arrangement shown in FIG. 1.

An enlarged cross-section of a single stage of the regenerative pumping mechanism is shown in FIG. 2. For efficient operation of the regenerative pumping mechanism 14, it is important that the radial clearance "C" between rotor blades 38 and stator 26 is closely controlled, and preferably kept to no more than 200 microns or less, and preferably less than 80 microns, during operation. An increase in clearance "C" would lead to significant seepage of gas out of pumping channel 40 and reduce efficiency of regenerative pumping mechanism 14. Therefore, regenerative pumping mechanism 14 is associated with the lubricated rolling bearing 30 which substantially resists radial movement of the drive shaft 32 and hence rotor body 36. However, if there is radial movement of the drive shaft at an end thereof distal from the lubricated bearing 30, this may also cause radial movement of the rotor of the regenerative pumping mechanism, resulting in loss of efficiency. In other words, bearing 30 may act as a pivot about which some radial movement may take place. To avoid loss of efficiency, the rotor 36 of the regenerative pumping mechanism is connected to the drive shaft 32 so as to be sufficiently close to the lubricated bearing 30 (i.e. the pivot) so that radial movement of distal end of the drive shaft translates substantially to axial movement of the rotor blades relative to respective circumferential pumping channels 40. Preferably, the bearing 30 is substantially axially aligned with the circumferential pumping channels so that any radial movement of the rotor blades 38 does not cause significant seepage. As shown, the stator 26 of the regenerative pumping mechanism 14 defines the recess for the bearing 30 and the rotor body 36 is, as it will be appreciated, adjacent the stator 26. Accordingly, the bearing 30, which resists radial movement, prevents significant radial movement of the rotor body 36 and also hence of the rotor blades 38. Therefore, clearance "C" between the rotor blades 38 and stator 26 can be kept within tolerable limits.

Extending orthogonally from the rotor body 36 are two cylindrical drag cylinders 46 which together form rotors of drag pumping mechanism 20. The drag cylinders 46 are made from carbon fibre reinforced material which is both strong and light. The reduction in mass when using carbon fibre drag cylinders, as compared with the use of aluminium drag cylinders, produces less inertia when the drag pumping mechanism is in operation. Accordingly, the rotational speed of the drag pumping mechanism is easier to control.

The drag pumping mechanism 20 shown schematically is a Holweck type drag pumping mechanism in which stator portions 48 define a spiral channel between the inner surface of housing part 24 and the drag cylinders 46. Three drag stages are shown, each of which provides a spiral path for gas flow between the rotor and the stator. The operation and structure of a Holweck drag pumping mechanism is well known. The gas flow follows a tortuous path flowing consecutively through the drag stages in series.

The molecular pumping mechanism 12 is driven at a distal end of drive shaft 32 from the regenerative pumping mechanism 14. A back up bearing may be provided to resist extreme radial movement of the drive shaft 32 during, for instance, power failure. As shown, the lubricant free bearing is a magnetic bearing 54 provided between rotor body 52 and a cylindrical portion 56 fixed relative to the housing 22. A passive magnetic bearing is shown in which like poles of a magnet repel each other resisting excessive radial movement of rotor body 52 relative to the central axis A. In practice, the drive shaft may move about 0.1 mm.

Figure 6:
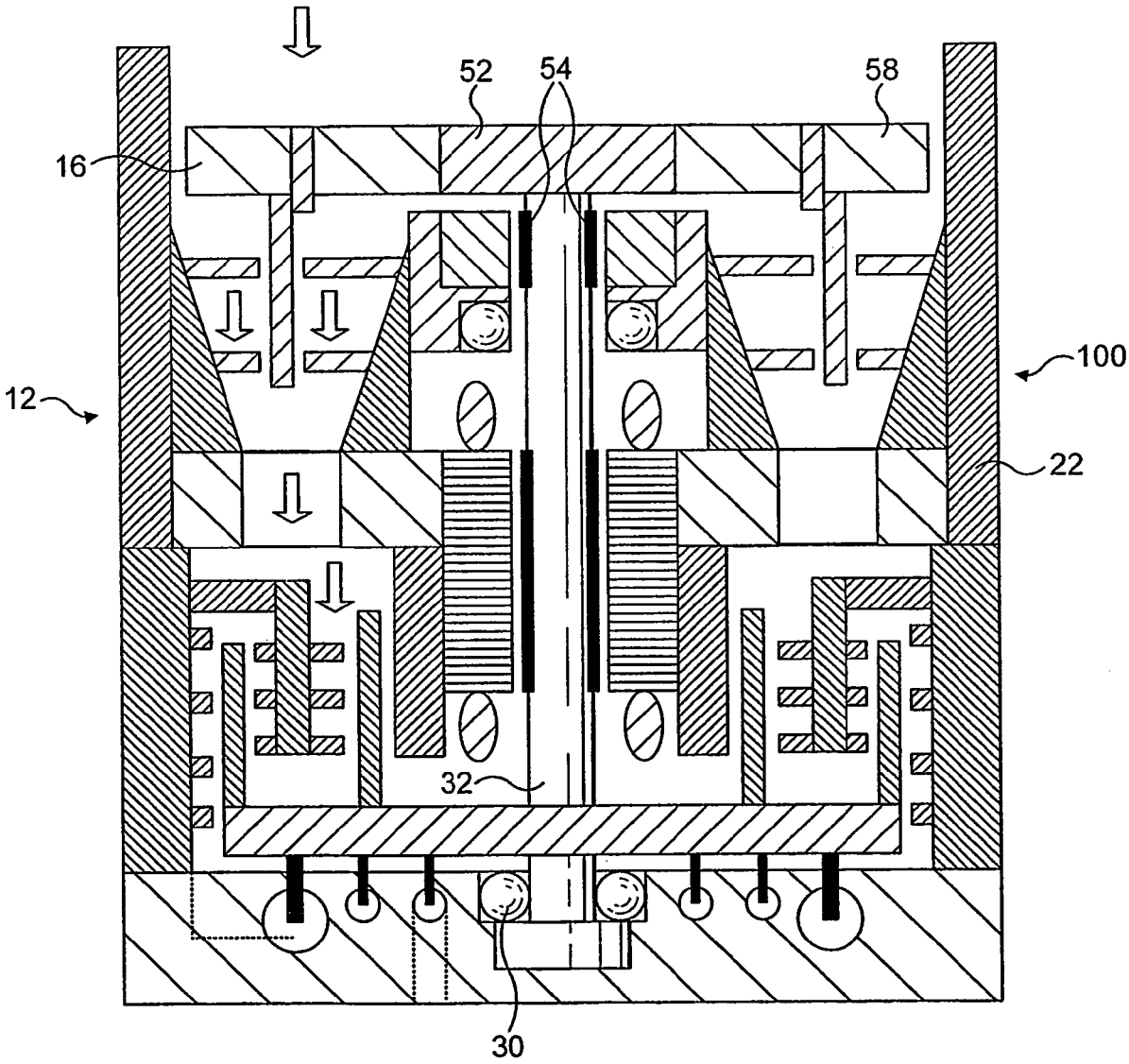
FIGS. 6 to 8 are cross-sectional views of further vacuum pumping arrangements all shown schematically.
Figure 7:
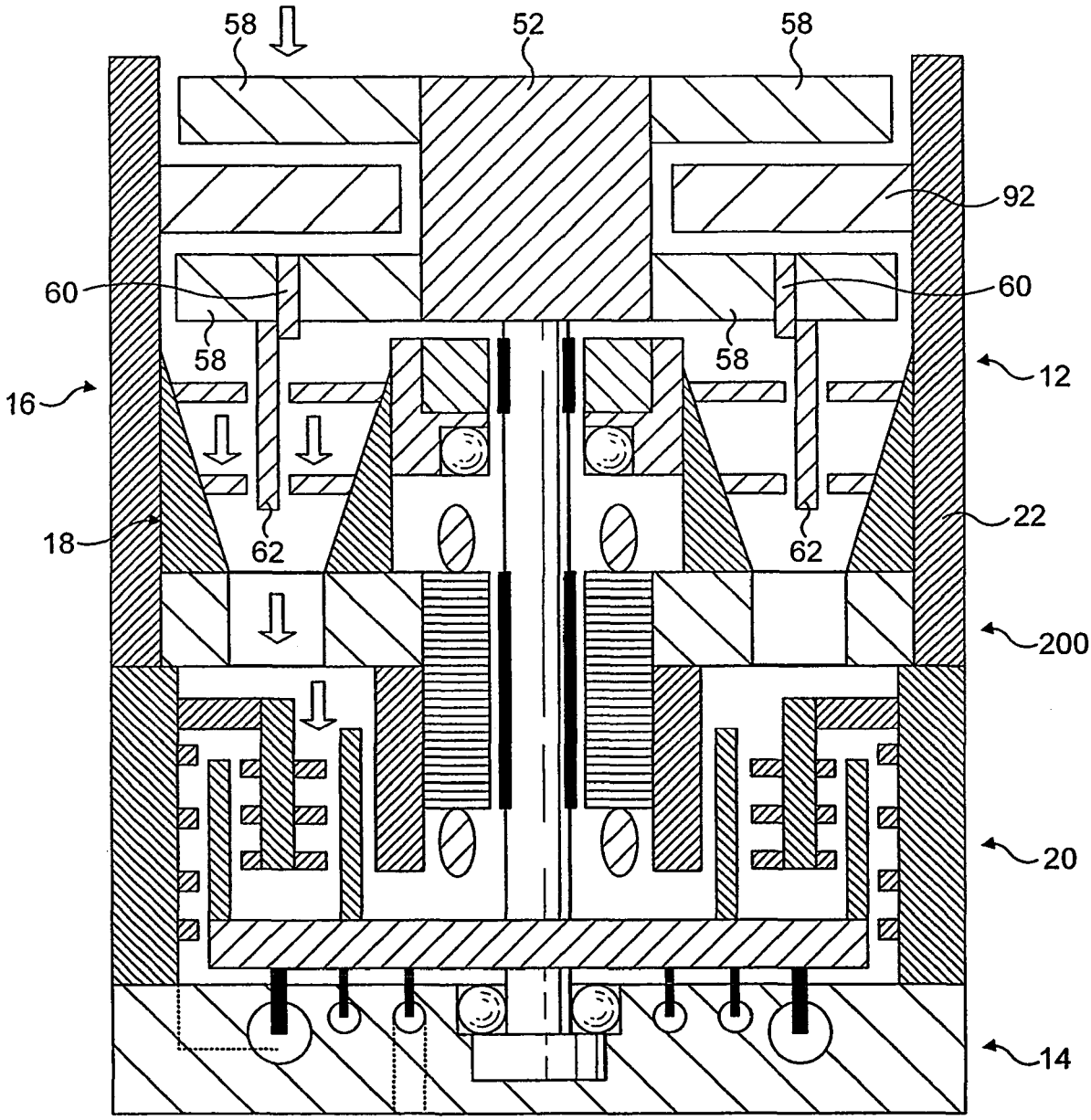
Figure 8:
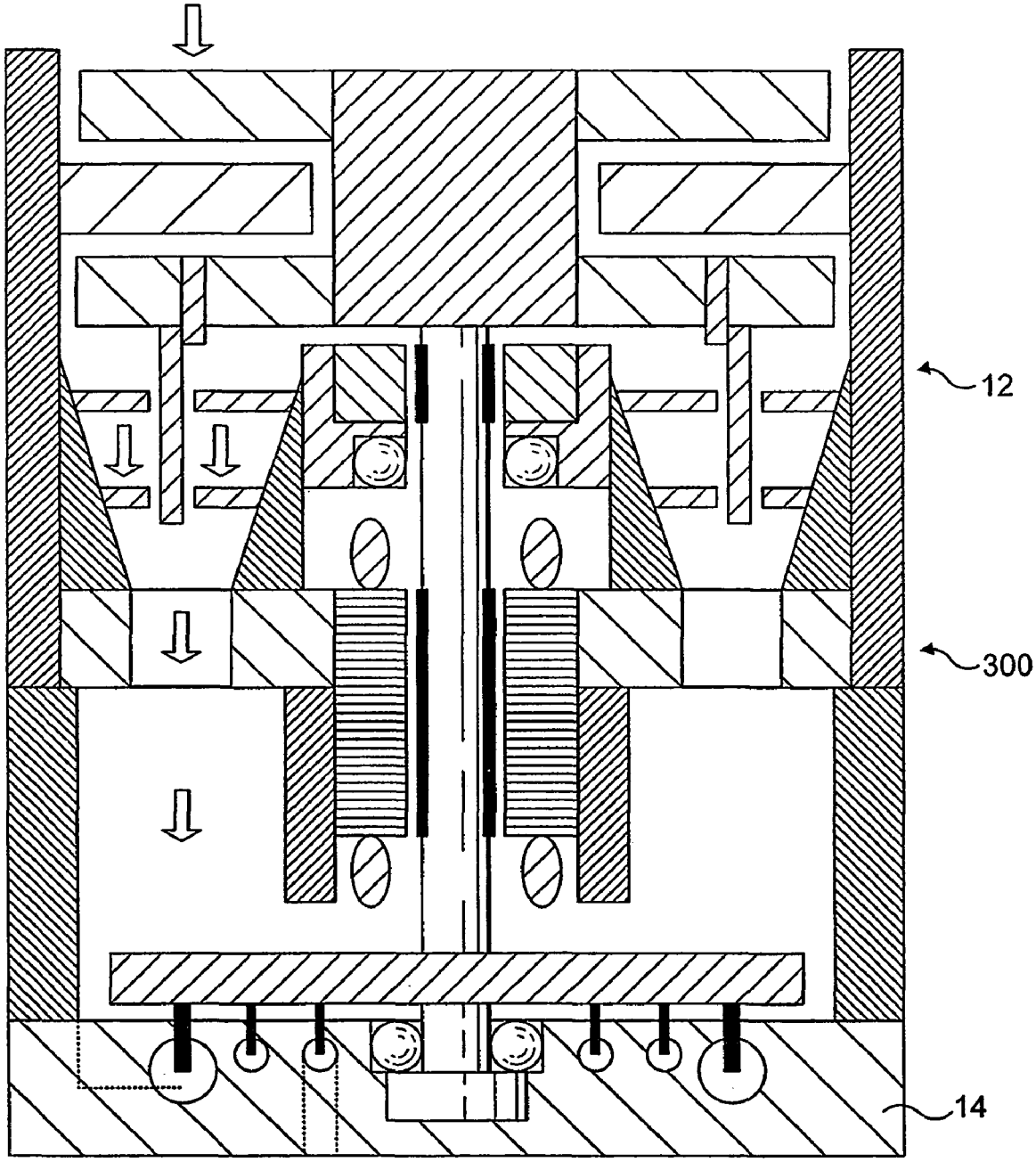

A small amount of radial movement of the rotor of a molecular pumping mechanism does not significantly affect the pumping mechanism's performance. However, if it is desired to further resist radial movement, an active magnetic bearing may be adopted. In an active magnetic bearing, electro magnets are used rather than permanent magnets in passive magnetic bearings. Further provided is a detection means for detecting radial movement and for controlling the magnetic field to resist the radial movement. FIGS. 6 to 8 show an active magnetic bearing.

A circumferential array of angled rotor blades 58 extend radially outwardly from rotor body 52. At approximately half way along the rotor blades 58 at a radially intermediate portion of the array, a cylindrical support ring 60 is provided, to which is connected drag cylinder 62 of drag pumping mechanism 18. Drag pumping mechanism 18 comprises two drag stages in parallel with a single drag cylinder 62, which may be made from carbon fibre to reduce inertia. Each of the stages is comprised of stator portions 64 forming with the tapered inner walls 66 of the housing 22 a spiral molecular gas flow channel. An outlet 68 is provided to exhaust gas from the drag pumping mechanism 18.

During normal operation, inlet 70 of pump arrangement 10 is connected to a chamber, the pressure of which it is desired to reduce. Motor 34 rotates drive shaft 32 which in turn drives rotor body 36 and rotor body 52. Gas in molecular flow conditions is drawn in through inlet 70 to the turbomolecular pumping means 16 which urges molecules into the molecular drag pumping means 18 along both parallel drag pumping stages and through outlet 68. Gas is then drawn through the three stages in series of the drag pumping mechanism 20 and into the regenerative pumping mechanism through inlet 42. Gas is exhausted at atmospheric pressure or thereabouts through exhaust port 44.

Regenerative pumping mechanism 14 is required to exhaust gas at approximately atmospheric pressure. Accordingly, the gas resistance to passage, of the rotor blades 38 is considerable and therefore the power and torque characteristics of motor 34 must be selected to meet the requirements of the regenerative pumping mechanism 14. The resistance to rotation encountered by the molecular pumping mechanism 12 is relatively little, since the molecular pumping mechanism operates at relatively low pressures. Furthermore, the structure of the drag pumping mechanism 18 with its only moving part being a cylinder rotated about axis A does not suffer significantly from gas resistance to rotation. Therefore, once power and torque characteristics for motor 34 have been selected for regenerative pumping mechanism 14, only a relatively small proportion of extra capacity is needed so that the motor also meets the requirements of molecular pumping mechanism 12. In other words, a 200 w motor, which is typically used for a molecular pumping mechanism, is significantly less powerful than motor 34 which preferably is a 2 kw motor. In the prior art, the typical motor is not powerful enough so that pressure change in a chamber can be controlled by controlling the rotational speed of the pump. However, since a powerful motor is selected to drive regenerative pumping mechanism 14, the additional power can also be used to control rotational speed of the molecular pumping mechanism and thereby control pressure.

Figure 4:
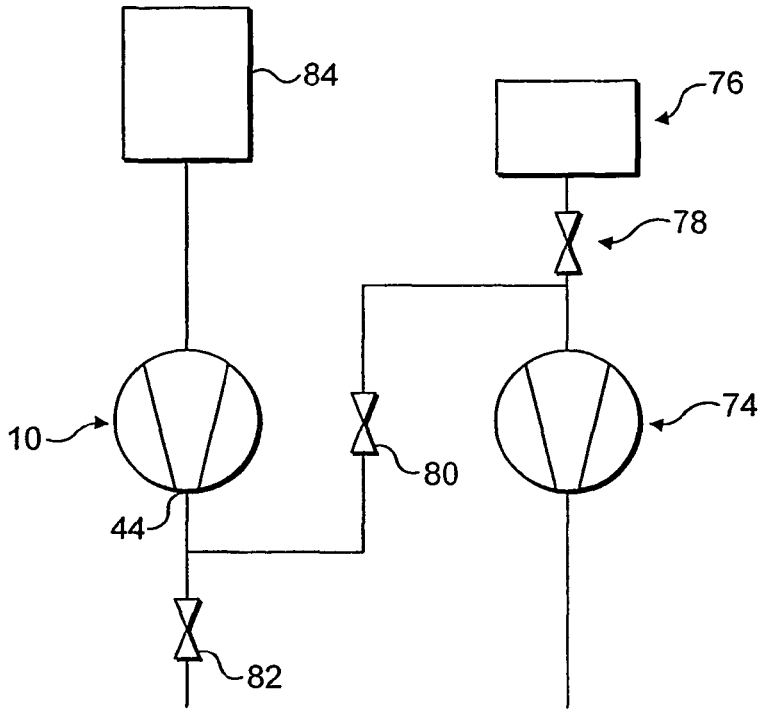
FIG. 4 is a schematic representation of a vacuum pumping system.
Figure 5:
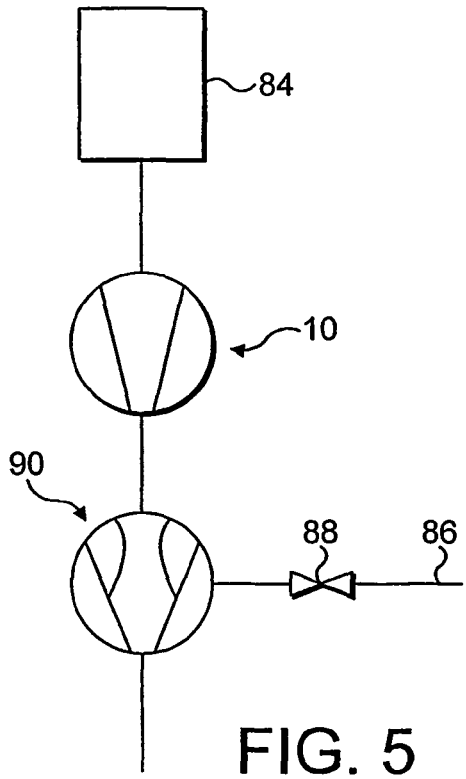
FIG. 5 is a schematic representation of another vacuum pumping system.

A typical turbomolecular pumping means is evacuated to relatively low pressures before it is started up. In the prior art, a backing pumping mechanism is used for this purpose. Since the backing pumping mechanism and turbomolecular pumping means are associated with the same drive shaft in vacuum pumping arrangement 10, this start up procedure is not possible. Accordingly, the vacuum pumping arrangement forms part of a vacuum pumping system which comprises additional evacuation means to evacuate at least the molecular pumping mechanism 12 prior to start up to a predetermined pressure. Preferably, the molecular pumping mechanism is evacuated to less than 500 mbar prior to start up. Conveniently, the whole vacuum pumping arrangement is evacuated prior to start up, as shown in FIGS. 4 and 5. The evacuation means may be provided by an additional pump, although this is not preferred since an additional pump would increase costs of the system. When the pumping arrangement 10 is used as part of a semi-conductor processing assembly, it is convenient to make use of a pump or pumping means associated with the system such as the pump for the load lock chamber. FIG. 4 shows the arrangement of a semiconductor processing system, in which the load lock pump 74 is, in normal use, used to evacuate pressure from load lock chamber 76. A valve 78 is provided between load lock chamber 76 and load lock pump 74. Load lock pump 74 is connected to the exhaust of pumping arrangement 10 via valve 80. A further valve 82 is provided downstream of exhaust 44 of pumping arrangement 10. During start up, valve 78 and valve 82 are closed whilst valve 80 is opened. Load lock pump 74 is operated to evacuate gas from arrangement 10 and therefore from turbomolecular pumping means 16. During normal operation, valves 82 and 78 are opened whilst valve 80 is closed. Arrangement 10 is operated to evacuate pressure from vacuum chamber 84.

Alternatively, vacuum pumping arrangement 10 can be started up as described with reference to FIG. 5. The additional evacuation means comprises a high pressure nitrogen supply which is connected to an ejector pump 90 via valve 88. Valve 88 is opened so that high pressure nitrogen is ejected to evacuate arrangement 10 and therefore turbomolecular pumping means 16. Nitrogen is a relatively inert gas at normal operating temperatures of the system and does not contaminate the system.

Although the pumping arrangement 10 may be evacuated prior to start up, it is also possible to evacuate the arrangement after or during start up, since the arrangement can be started but will not reach suitable rotational speeds until evacuation is performed. However, if the arrangement and in particular the turbomolecular pumping means is started prior to or during evacuation, torque of the motor is preferably limited to prevent overloading until evacuation is performed.

There now follows a description of three further embodiments of the present invention. For brevity, the further embodiments will be discussed only in relation to the parts thereof which are different to the first embodiment and like reference numerals will be used for like parts.

FIG. 6 shows a vacuum pumping arrangement 100 comprising an active magnetic bearing in which a cylindrical pole of the magnetic bearing 54 is mounted to the drive shaft 32 with a like pole being positioned on housing 22. The rotor body 52 of the turbomolecular pumping means 16 of the molecular pumping mechanism, is disc-shaped and the overall size of the arrangement 100 is reduced as compared with the first embodiment.

In FIG. 7, a vacuum pumping arrangement 200 is shown in which the turbomolecular pumping means 12 comprises two turbomolecular pumping stages 16. A stator 92 extends radially inwardly from housing part 22 between the two turbo stages 16.

In FIG. 8, a vacuum pumping arrangement 300 is shown in which molecular drag pumping mechanism 20 has been omitted.

I claim:

1. A vacuum pumping system having a process chamber, a load lock chamber, and a vacuum pumping arrangement comprising:

a drive shaft;

a motor for driving the drive shaft;

a molecular pumping mechanism comprising turbomolecular pumping means;

a backing pumping mechanism, wherein the drive shaft is for driving the molecular pumping mechanism and the backing pumping mechanism; and an evacuation means for evacuating at least the turbomolecular pumping means prior to start up of the molecular pumping mechanism, wherein the evacuation means is decoupled from the load lock chamber during the start up of the molecular pumping mechanism, and decoupled from the molecular pumping mechanism in a manner that exhaust fluid from the molecular pumping mechanism bypasses the evacuation means during normal operation of the molecular pumping mechanism.

2. The system as claimed in claim 1, wherein the vacuum pumping arrangement forms part of a semiconductor processing assembly and the evacuation means comprises a pump associated with the semiconductor processing assembly.

3. The system as claimed in claim 2, wherein the pump is a pump for a load lock chamber of the semiconductor processing assembly.

4. The system as claimed in claim 1, wherein the evacuation means comprises an ejector pump.

5. The system as claimed in claim 1, wherein the backing pumping mechanism comprises a regenerative pumping mechanism.

6. The system as claimed in claim 1, wherein the molecular pumping mechanism comprises molecular drag pumping mechanism.

7. The system as claimed in claim 1, wherein the evacuation means is for evacuating the vacuum pumping arrangement.

8. A method of operating a vacuum pumping arrangement in a system having a process chamber and a load lock chamber, the vacuum pumping arrangement having an evacuation means, a drive shaft; a motor for driving the drive shaft; a molecular pumping mechanism having turbomolecular pumping means; and a backing pumping mechanism, wherein the drive shaft is for driving the molecular pumping mechanism and the backing pumping mechanism, the method comprising the steps of: decoupling the evacuation means from the load lock chamber during the start up of the molecular pumping mechanism; operating an the evacuation means connected to the arrangement to evacuate the turbomolecular pumping means to a predetermined pressure; operating the motor to start rotation of the drive shaft; and decoupling the evacuation means from the molecular pumping mechanism in a manner that exhaust fluid from the molecular pumping mechanism bypasses the evacuation means during normal operation of the molecular pumping mechanism.

9. The method as claimed in claim 8, wherein the motor rotates the drive shaft when the predetermined pressure has been attained.

10. The method as claimed in claim 8, further comprising the step of starting the motor before or during evacuation of the turbomolecular pumping means to the predetermined pressure; limiting the torque of the motor to prevent overloading before evacuation; and operating the evacuation means to evacuate at least the turbomolecular pumping means to the predetermined pressure.

11. The method as claimed in claim 8, wherein the vacuum pumping arrangement forms part of a semiconductor processing assembly having a pump associated therewith which forms the evacuation means, further comprising the steps of connecting the pump to the arrangement and operating the pump to evacuate at least the turbomolecular pumping means to the predetermined pressure.

12. The method as claimed in claim 8, wherein the evacuation means comprises an ejector pump further comprising the steps of connecting the ejector pump to the arrangement; and operating the ejector pump to evacuate at least the turbomolecular pumping means to the predetermined pressure.

13. The method as claimed in claim 8, wherein the vacuum pumping arrangement is evacuated to the predetermined pressure.

14. The method as claimed in claim 8, wherein the predetermined pressure is 500 mbar or less.

15. The system as claimed in claim 5, wherein the molecular pumping mechanism comprises molecular drag pumping mechanism.

16. The system as claimed in claim 4, wherein the evacuation means is for evacuating the vacuum pumping arrangement.

17. The method as claimed in claim 13, wherein the predetermined pressure is 500 mbar or less.

* * * * *